United States Patent [19]

Ushikoshi

[11] Patent Number: 4,545,686

[45] Date of Patent: Oct. 8, 1985

[54] ELECTRONIC TIMEPIECE

[75] Inventor: Kenichi Ushikoshi, Suwa, Japan

[73] Assignee: Kabushiki Kaisha Suwa Seikosha, Tokyo, Japan

[21] Appl. No.: 360,970

[22] Filed: Mar. 23, 1982

[30] Foreign Application Priority Data

Mar. 24, 1981 [JP] Japan ..... 56-43050
Dec. 28, 1981 [JP] Japan ..... 56-213245

[51] Int. Cl.[4] ..... G04B 21/08; G04B 23/02
[52] U.S. Cl. ..... 368/63; 368/74
[58] Field of Search ..... 368/76, 80, 72–74, 368/108–113, 223–224, 228; 368/63

[56] References Cited

U.S. PATENT DOCUMENTS 4,205,519 6/1980 Deruns ..... 368/73
4,259,737 3/1981 Berney ..... 368/66
4,266,288 5/1981 Berney ..... 368/28
4,337,529 6/1982 Morokawa ..... 368/10
4,358,840 11/1982 Ono et al. ..... 368/251
4,407,587 10/1983 Fujita ..... 368/108

*Primary Examiner*—Vit W. Miska
*Attorney, Agent, or Firm*—Blum Kaplan Friedman Silberman & Beran

[57] ABSTRACT

An electronic timepiece of the analog type including a timer is provided. A sound producing function is used for indicating the timer or alarm and this function is separated from the basic watch timekeeping circuitry. The sound producing function is easily incorporated into the timepiece without increasing the size of the timepiece. Setting of a timer function is accomplished by operation of an external member and the results of operating the external member are audibly indicated. In alternative embodiments, the second hand of the watch provides a visual indication of the time remaining in the selected time period, and a chronograph function may be provided.

22 Claims, 9 Drawing Figures

ELECTRONIC TIMEPIECE

BACKGROUND OF THE INVENTION

This invention relates generally to an electronic timepiece having an additional function which relies on a sound producing element such as a buzzer or a speaker. Where a fundamental or basic watch having hands for indicating the time is equipped with additional functions such as a timer and a chronograph, the resultant mechanism would be complex in construction if operation systems and display or indication systems were completely coupled with each other. In electronic timepieces of the prior art having alarms or timers, it is necessary to set the time at which the alarm should sound. Such an alarm time is set as follows. First, an externally actuatable button on a digital display is depressed to call up for correction the mode for the time at which the timer is to be set. Then, the time is called by a select button in a correctable manner, and another externally actuatable button is used to set the timer for the desired hour. The foregoing operation is repeated to set the timer for the desired minute. After the proper period of time has elapsed, the timer alarm is set off.

Thus, a tedious and time-consuming procedure has to be completed to set the timer or alarm to a time when the user is to rely on the timer or alarm signal. The conventional prior art alarm or timer functions have not found wide-spread use in practice. Further, an analog timer, in order to be equipped with a visual display mechanism, needs to have a setting mechanism including an array of wheels and hands. Such an arrangement is complicated in structure and accordingly, is not generally accepted for design purposes.

Another difficulty with analog timepieces including a timer or alarm function is in presenting an indication that the timer or alarm is set, and when actuation can be expected to occur. Intervals of time for which a timer is set may be indicated on a display device such as a liquid crystal display, but an arrangement for bringing a mechanical hand to a desired position is complex in structure and is not easily accomplished.

What is needed is an electronic timepiece which provides auxiliary functions of a timer or chronograph which are simple and substantially independent of the timekeeping functions of the watch. An indication of the timer or alarm setting is also desirable.

SUMMARY OF THE INVENTION

Generally speaking, in accordance with the invention, an electronic timepiece of the analog type and also including a timer is provided. A sound producing function is used for indicating the timer or alarm and this function is separated to the greatest possible degree from the basic watch, that is, from the timekeeping circuitry. The sound producing function is used for another mode of operation, other than timekeeping, so that sophisticated functions such as a timer and a chronograph are easily incorporated into the timepiece without increasing the size of the timepiece and with only a slight cost increase. Setting of a timer function is accomplished by operation of an external member and the results of operating the external member are audibly indicated. In alternative embodiments, the second hand of the watch provides a visual indication of the time remaining in the selected time period, and a chronograph function may be provided.

Accordingly, it is an object of this invention to provide an improved electronic timepiece having a timer function whose operation and indication are independent of those of the basic timekeeping portions of the watch.

Another object of this invention is to provide an improved electronic timepiece with a timer function which indicates time remaining in a selected time period by a visible motion of the hands.

Yet another object of this invention is to provide an improved electronic timepiece with a timer function which provides audible indications of timer setting operations.

Still another object of this invention is to provide an improved electronic timepiece with a timer which provides audible outputs during the timed period.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

With reference to FIG. 1, an electronic timepiece in accordance with the invention comprises a basic or fundamental watch unit including a reference oscillator 1, frequency divider 2, driver 3, decoder for digital display or motor 4 for an analog indicator, and indicator 5.

Figure 1:
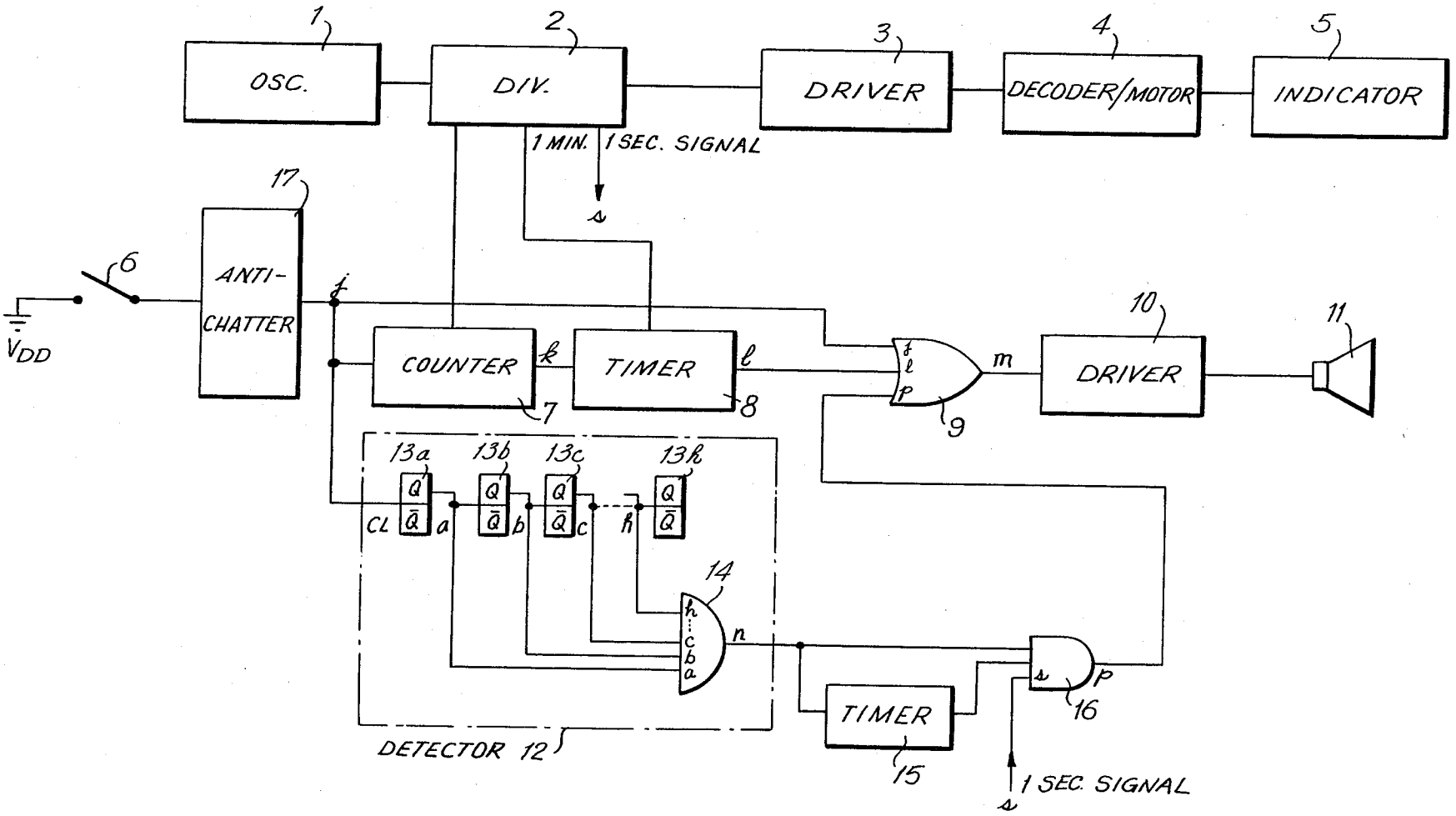
FIG. 1 is a functional circuit diagram of a timepiece with timer function in accordance with the invention.

The timepiece of FIG. 1 also includes a timer unit comprised of an input switch 6, anti-chatter circuit 17, counter 7, timers 8, 15, OR gate 9, AND gate 16, driver circuit 10 for driving a speaker or buzzer, and an output 11 including a buzzer or speaker for producing an audible sound. The circuit also includes a detection circuit 12 for determining how many times the input switch 6 is operated. The detection circuit 12 includes a string of T-type flip-flops which are triggered by the leading edge of the signal going positive, and AND gate 14.

Operation of the circuit of FIG. 1 is now described. The basic watch comprises a known electronic watch in which a signal from the reference oscillator 1 of high frequency is divided down by the frequency divider circuit 2 into another signal of lower frequency which is then shaped by the driver circuit 3 into a signal suitable for driving the motor or a digital display. The shaped signal drives the indicator 5 through the motor or decoder 4. An analog watch may be corrected by operating a conventional crown (not shown) to slip an array of wheels in the indicator 5 for bringing the hands to the desired positions, or corrections may be made by supplying electronic correction signals to the motor 4 for quick correction.

The timer unit is independent of the indicator 5 in the basic watch, and operates independently of the basic watch although drawing frequency signals from the divider 2. In operating the timer, a signal from the external switch 6 is inputted to the counter 7. When the switch 6 is actuated several times, a signal k which is indicative of the number of operations of the switch 6 is outputted from the counter 7 to the timer 8. The timer 8 produces an output l several minutes later at a time which corresponds in minutes to the signal k. Thus, each operation of the switch 6 adds an increment of time which must elapse before an output is provided to the driver 10.

Although the counter 7 and timer 8 are illustrated separately for the convenience of description in FIG. 1, only the counter 7 need be used to produce such an output l by means of a changeover operation in the counter 7, e.g., an up-down counter. The output l is fed to the OR gate 9, shaped and amplified by the buzzer driver circuit 10, and energizes the buzzer 11.

Each time the switch 6 is actuated, a signal j is supplied from the switch 6 directly to the OR gate 9 so that the buzzer 11 sound and by its sounding informs the user how many times the timer unit is supplied with inputs simultaneously with actuation of the switch 6. This audible sound eliminates visual checking which would be required in a conventional timer watch. Therefore, the switch 6 can be actuated while the user is confirming the number of operations only by means of his ear, thereby setting and starting the timer unit. The user does not have to look at the timepiece indicator to know the number of increments of time for which the timer is set. If a buzzer sound for confirmation of actuations of the switch 6 is not necessary, the buzzer may be connected so as not to give off such sound, or the input j may be removed from the OR gate 9. Such a modification will be apparent to those skilled in the art.

The detection circuit 12 is supplied with the input j from the switch 6. The input j is fed as a clock to a conventional T-type flip-flop which reverses its output a each time a clock signal is input (goes positive). The detection circuit 12 serves to determine whether the switch 6 is operated once, for example, or more frequently.

Figure 2A:
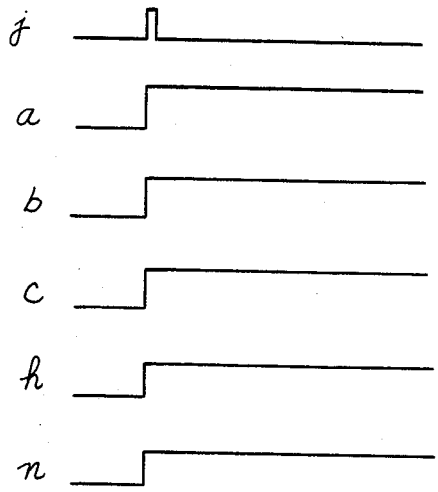
FIGS. 2*a* and 2*b* are timing charts showing signals in the circuit of FIG. 1.

When the switch 6 is actuated only once, the elapsing time is indicated by a sound because the outputs of the T flip-flops 13*a*, 13*b* . . . 13*h*, that is, outputs a,b, . . . h go to high logic levels such that the AND gate 14 produces a high level output signal n. FIG. 2 is a timing chart indicating the response from the flip-flops of an input signal j in producing high outputs from the flip-flops 13*a–h* and from the AND gate 14, that is, signal n.

The high signal n from the AND gate 14 starts the timer 15 which for purposes of explanation and example is here assumed to be a one-minute timer. High signals from the AND 14 and the timer 15, and a frequency signal s from the frequency-divider circuit 2 are simultaneously inputted to the AND gate 16. The signal s from the divider 2 is at the rate of one cycle per second and the output p of the AND gate 16 is delivered to the OR gate 9 to energize the buzzer 11 through the driver circuit 10. The intervals at which the buzzer 11 emits sounds are controlled by the signal s supplied to the OR gate 16, in this example, once every second. Thus, the timer unit serves not only as a timer but also provides repeating audible signals to let the user know the time which is elapsing.

Where the signal s is in the form of a rectangular wave having a pulse width of 1/16 milliseconds, the buzzer 11 produces a sound as of "pi" every second for a one minute period when the switch 6 has been actuated only once. Whereas in the illustrated embodiment, the signal s is fed to the AND gate 16 every second, other signals s which are generated, for examples, every five or ten seconds, may be supplied so that the buzzer 11 gives off a sound of "pi" at those intervals, or there may be a "pi" every second and, for example, a voice every ten seconds. Thus, various sounding systems may easily be produce to suit a variety of applications.

Figure 2B:
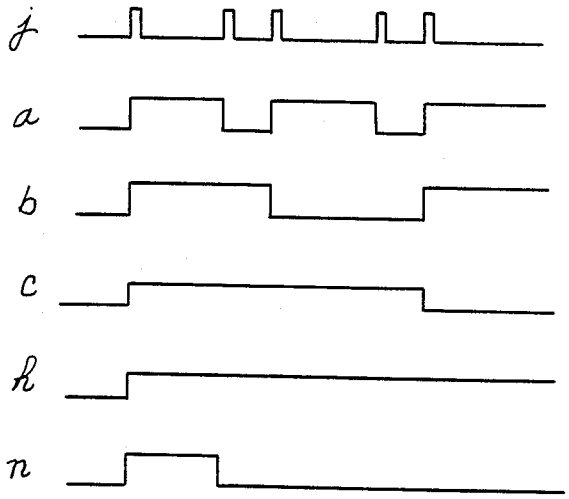

On the other hand, when the switch 6 is actuated twice or more, the AND gate 14 in the detection circuit 12 produces a low level for its output signal n. Thereupon, the subsequent operation, that is, repeated one second outputs, is not effected except that the timer unit functions as a timer watch by using the counter 7/timer 8. As shown in FIG. 2*b*, an input signal j from the switch 6 is applied several times, more particularly, five times as illustrated. The T-type flip-flops produce outputs a,b which are frequency divided by one-half, so that the AND gate 14 supplied with these output a,b produces a signal n which is at the low logic level after the second input signal j has been supplied. Application of the low signal n to the AND gate 16 causes the AND gate 16 to generate an output p which is low. Thus, the signal p to the OR gate 9 is low, and the buzzer 11 remains de-energized although operations of the switch 6 are still sounded when there is direct connection between the anti-chatter circuit 17 and the OR gate 9 as described above.

The foregoing operation in which the switch 6 is actuated twice or more frequently has been described with reference to the circuit arrangement which is the same as for the first mode of operation in which the switch 6 is actuated only one time. When the switch is actuated only one time, the elapsing time is audibly anounced by one second signals but this one second signal is absent when the switch 6 is actuated twice or more frequently. In an alternative embodiment, a mode of operation may be effected using an electronic circuit in which, when the switch 6 is operated twice or more frequently, the time elapsing is audibly announced in the final one minute by time signals, or the time may not be announced for a few minutes after actuation of switch 6 but then audibly announced for the remaining time, or the time may be audibly announced just after the switch 6 is operated for a preselected initial period of time, followed by silence until the end of the timed period. More specifically, the output j is supplied directly from the switch 6, and anti-chatter circuit 17 to the timer 15, and then while the output of the timer is high, the one second signal is fed directly to the OR gate 9 through the AND gate 16. It should readily be understood that the time interval for which the elapsing time is audibly sounded, that is, the time when the output of the timer 15 is high, need not necessarily be one minute but may be selected as desired.

It should be understood that means (not shown) for resetting the flip-flop 5 13*a–h* to the initial state are provided for actuation when, for example, the timer 8 provides a high output l.

Further, means (not shown) for resetting the counter 7, timer 8 and detector 12 to the initial state prior to completion of a previously selected timed interval, are provided for actuation by an external member (not shown), or by a special sequence of actuations of the switch 6.

In another embodiment of an electronic timepiece with timer in accordance with the invention, the timer unit may be set not only for minutes but for hours and minutes with a single push-button. An electronic circuit which enables the timer unit to be set for hours by depressing the push-button for one second or longer, and be set for minutes by depressing the push-button for 0.5 seconds or less, is readily constructed by a decision circuit for distinguishing between hours and minutes by comparison of the switch generated signal j with a signal generated for one second subsequent to the initiation of the signal j.

That is, for example, a circuit branch having a counter 7' and timer 8' in series may be placed in parallel with the counter 7 and timer 8. The decision circuit, located intermediate the anti-chatter circuit 17 and the counters 7,7' directs the signals j to the counter 7 for operations as described above, when the pulse width of the signal generated by operating the switch 6 is 0.5 seconds or less. The decision circuit directs the signals j to the counter 7' when the pulse width of the signal generated by operating the switch 6 is one second or longer. The counter 7'/timer 8' operate in the same manner as described above except that one-hour signals are input to the timer 8'0 from the divider 2. The timer 15 may operate, as before, to indicate elapsing time upon one switch actuation. Also, as before, the sounding time and repetition rate can be selected by selecting the signal s and the output of the timer 15.

The circuit is readily designed to have a buzzer give off sounds such as "ping pong" when the timer unit is set for an hour, and sounds such as "pi" when the timer unit is set for minute. With such an arrangement, the timer unit is set by only depressing the push-button, and it is not necessary to look at the timepiece in this process. This audible techniques has a great advantage over the conventional procedure in prior art timepieces wherein a timer is selectively operated for hours and minutes and set for a desired hour and minute while looking at the display.

A timepiece having a chronograph as an additional function is now described. Various timepieces with analog chronographs have been proposed. One such timepiece comprises a mechanical timepiece in which a fourth wheel for a second hand is provided with a friction clutch for switching between a chronograph and a conventional watch through actuation of an external button. Another example of a prior art timepiece with chronograph is a quartz crystal watch having two motors, one motor devoted to an array of wheels which is exclusively used for the chronograph as shown in Japanese Laid-Open Patent Publication No. 49-95656. The other motion is devoted to timekeeping. In either arrangement, the mechanical structures, such as an array of wheels for each function and a mechanism for returning the hand to a 0-second position, are required.

Figure 4:
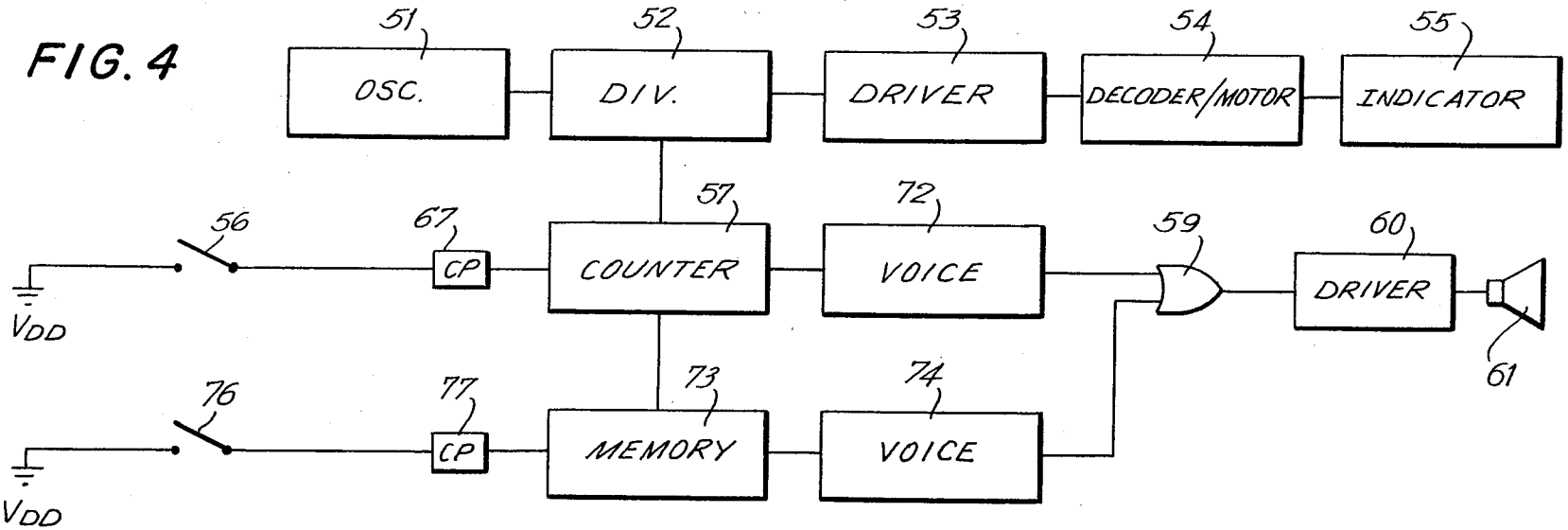
FIG. 4 is a functional circuit diagram of an alternative embodiment of an electronic timepiece with timer function in accordance with the invention.

In FIG. 4, a basic watch unit comprises an oscillator 51, frequency divider 52, driver 53, decoder or motor 54, and time indicator 55, the operation of which has been described with reference to the embodiment of FIG. 1 and is generally known. Accordingly, a repetitive description is not given here.

A chronograph unit, which is included as an additional function, comprises input switches 56, 76, anti-chatter circuits 67, 77, a counter 57, voice producing circuits 72, 74, memory 73, OR gate 59, speaker driver circuit 60, and speaker 61.

The chronograph unit operates as follows. When the switch 56 is actuated, the counter 57 begins counting and at the same time the voice producing circuit 72 generates a sound similar to a human voice saying "start", which sound is amplified by the speaker driver circuit 60 and emitted from the speaker 61. During this time, the counter 57 continues the counting process. When the switch 76 is closed, the memory 73 stores data on the time interval measured up to the instant when the switch 76 is actuated. Also, the voice producing circuit 74 and the speaker driver circuit 60 enable the speaker 60 to announce the time interval of the result measured.

Continuous time measurement with the chronograph unit allows lap times to be measured. Resetting of the chronograph unit to the zero position by closing the switch 76 and the switch 56 can be readily effected by electronic circuits. For example, simultaneous inputs from the switches 56, 76 to a two-input AND gate (not shown) can provide an output signal for resetting the counter 57. Therefore, no complex mechanical parts are necessary. The chronograph unit, as described, has different operation and indication systems than those of the basic watch such that the chronograph function is performed with voice sounds and does not rely on the hands of the timekeeping function. Chronograph timepieces which may be of either digital or analog construction for timekeeping, can readily be made available by designing switch operating buttons which do not impair the appearance of a conventional thin or low profile, well-designed watch without a chronograph.

Similar circuit structures may be added to announce dates, days of the week, years and the like with voice sounds, and various other applications may be possible.

Figure 3:
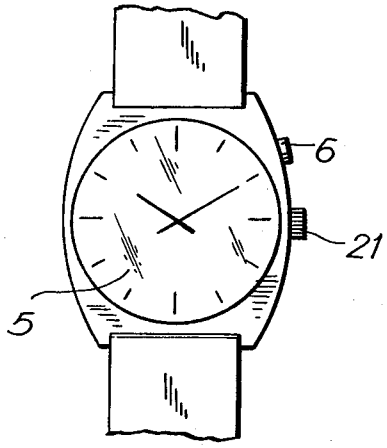
FIG. 3 is a face view of a two-hand analog watch in accordance with the invention.

FIG. 3 presents the external appearance of a watch which has a circuit arrangement and operating timer unit as shown in FIG. 1. The analog watch has an indicator 5 including hour and minute hands. The hands may be brought to desired positions by a crown 21 which itself is known, or the hands may be moved to a desired position by an electronic correction circuit. The crown 21 may be designed so as to be depressable whereby the crown 21 can double as the switch 6 is addition to performing the normal watch functions. In FIG. 3, the crown 21 and the push-button switch 6 are provided separately. The watch of FIG. 3 operates as follows:

(1) If the watch is to be used as a one-minute timer, the button 6 is depressed just one time. The watch then generates a buzzer sound every second, and the buzzer is de-energized after one minute has elapsed. This is the function of announcing the time as it elapses.

(2) When the watch is to be used as a timer for two or more minutes, the number of depressions of the button 6 is confirmed as the buzzer gives off a sound for each operation of the button 6. It should be understood that sounds for confirming operation of the switch 6 are not a necessary requirement. Doing no more to the watch, the buzzer is energized when the time interval for which the timer is set expires. Each depression of the button 6 represents a fixed increment of time which will be allowed to elapse prior to sounding of the buzzer. This is the function of a timer watch.

Although buzzer sounds have been described, musical sounds or synthesized voices may be generated by advanced electronic circuits as sounds for announcing and confirming purposes. The timer may freely be designed to suit various applications such as timers which can be set for units of five minutes, an hour, ten seconds, and the like.

As described above, the basic watch and timer unit have independent operation and indication systems, and the timer unit can be set audibly rather than visually. The timer unit can also be set for desired time intervals simply by depressing the push-button without particularly selecting the hours and minutes. Such arrangements enable a simple timer watch to be incorporated in a low profile watch having two hands on the face. More specifically, conventional analog two-hand watches drive a hand intermittently in increments of from a few seconds to one minute so as to reduce power consumption by the motor. Thus, a complete watch is made quite thin. Incorporating an ordinary mechanical timer into such a thin watch would result in a complex construction although the remaining interval of time could be indicated by a digital display or by a hand through an array of speed reduction wheels. Such a combination would also be awkward to handle and use.

With the simple timer in accordance with the invention, a well designed watch such as a small-sized watch used by ladies can be equipped with a simple timer without impairing the appearance or changing the size of the watch. This is accomplished merely by providing the switch 6, adding a counter to the integrated circuit and attaching a piezoelectric element to the rear cover. Although two-hand watches are of good appearance, they are inconvenient in that there is no second hand and no movement of the watch can be confirmed.

In accordance with the invention, a buzzer sound is generated every second when the timer unit is used as a one-minute timer. Therefore, the watch can be utilized to measure or count pulses or as a pace-maker by depressing the switch 6, the user can determine whether the watch is in operation as it will emit a sound, and it is also possible to determine whether battery power supply is running low. When the buzzer is energized, it requires a relatively large instantaneous current of several milliamps to flow through the buzzer. When the battery cell is running low of power, the intensity of the buzzer sound tends to be reduced or the tone thereof is likely to change due to variations in the waveform of the signals driving the buzzer due to the voltage drop.

Three hand watches generally incorporate a system indicating the remaining power of a cell by moving the second hand in a different manner when the voltage drops from the movement in normal operation. Since there is no second hand in two-hand watches, it has not been possible in such watches to indicate the services life of the cell. With the subject invention, the operating life of the cell in a two-hand watch can be checked with no special device but by actuating the button 6 to check the buzzer sound for variations in intensity or tone which will be experienced when the voltage drops.

The present invention is applicable not only to analog watches but also to digital watches with liquid crystal display, and also for watches having a composite analog and digital display. The invention is also suitable for clocks. It can be applied to both two-hand and three-hand watches for the purpose of setting timers and announcing time which has elapsed.

Figure 5:
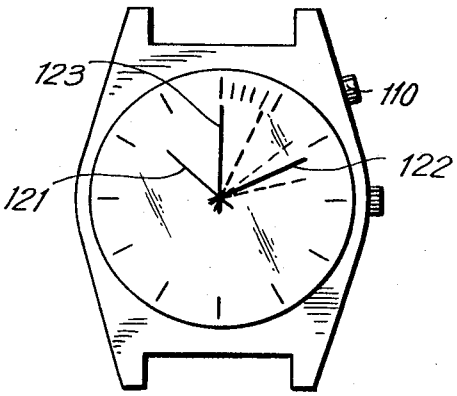
FIG. 5 is a view similar to FIG. 3 of a timepiece with a timer display in accordance with an alternative embodiment of the invention.

FIG. 5 shows an alternative embodiment of an analog watch having a push-button 110 which serves as an externally actuated switch. When the push-button 110 is depressed N times, the number N is stored in a circuit element. Where one depression of the push button 110 corresponds to one minute, for example, the watch, operating as a timer, will begin to sound N minutes later.

With such a construction, there is no way to determine externally for what interval of time the timer is set. It is not known during use whether the timer has been set or not, unless setting of the timer is indicated by continuously occurring buzzer sounds.

As described hereafter, an electronic circuit is used in the present invention to control the movement of a second hand 122 when the timer has been set so as to inform the user of the interval for which the timer is set and also of the period of time that has elapsed in the timer. Stated otherwise, movement of the second hand 123 as shown in FIG. 5 is controlled independently from the movement of the hour hand 121 and minute hand 122 when the timer is set.

Figure 6:
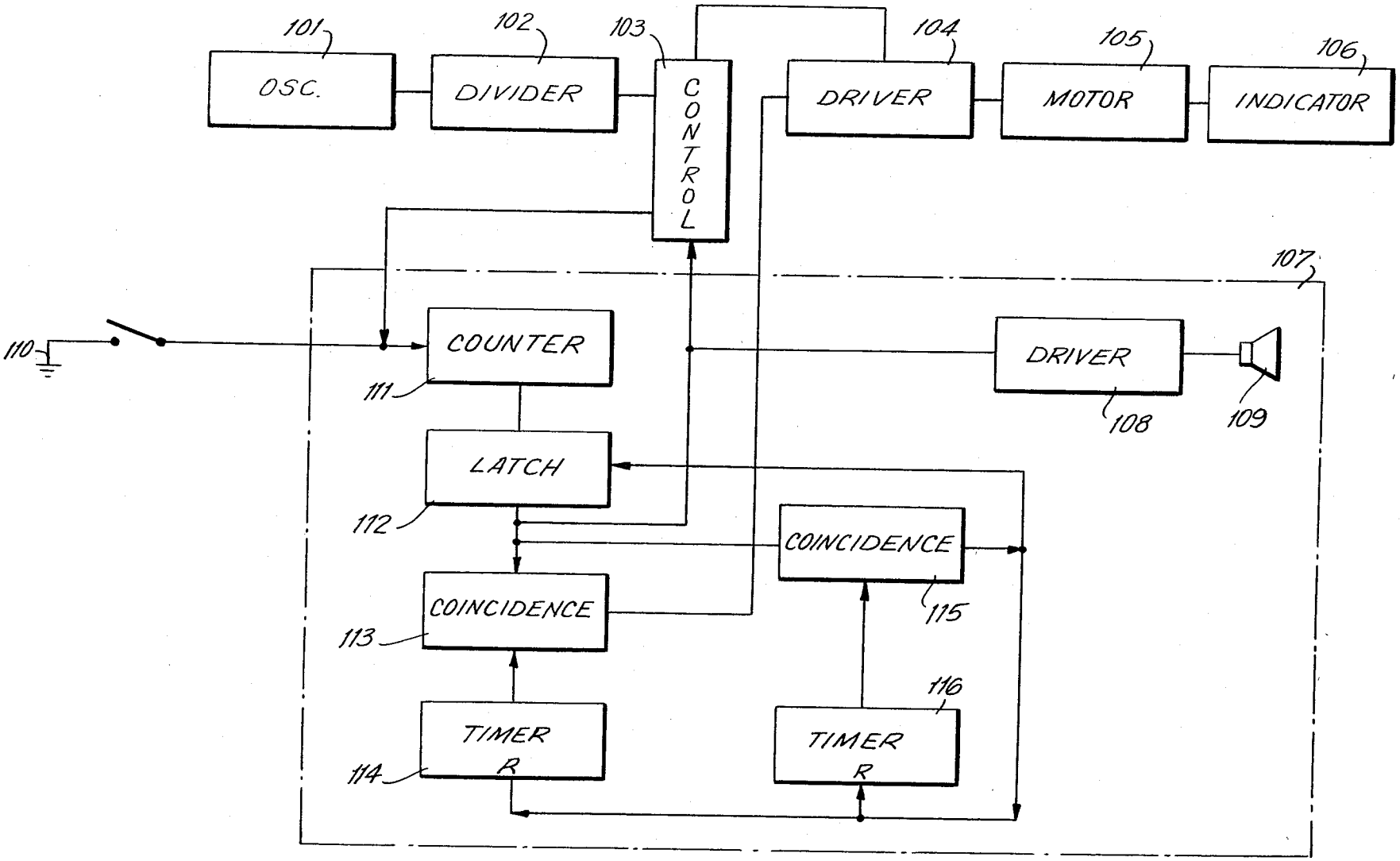
FIG. 6 is a functional block diagram of a timepiece embodiment in accordance with the invention.

FIG. 6 is a functional block diagram of an electronic timepiece with a timer in accordance with the invention. In this embodiment, an interval for which the timer is set is indicated in that the movement of a hand on the time indicator is varied as the remaining period of time in the timer changes. The timepiece illustrated comprises a quartz crystal watch including a time standard frequency generator 101 such as a crystal oscillator, and a frequency divider circuit 102 for frequency division down to minutes, necessary for a timer unit 107, indicated with broken lines. The timepiece also includes a motor driver circuit 104, motor 105, and time indicator 106 having an hour hand, minute hand and second hand which normally moves every second, the foregoing construction being well known.

The timer unit 107 comprises a timer setting counter 111 which is supplied with a signal from an externally actuated member 110, latch circuit 112 for storing data of the signal from the counter 111, counter 114 for counting a signal for rapidly moving the second hand, a coincidence circuit 113 for indicating coincidence between signals from the latch circuit 112 and the counter 114, a second counter 116 for counting signals generated every second by the divider 102, a coincidence circuit 115 for detecting coincidence between an output from the latch 112 and an output from the second counter 116, the coincidence circuit 115 supplying a clock signal to the latch 112 and resetting both the counter 114 and the second counter 117.

The timer unit 107 also comprises a buzzer energizing circuit or driver 108 with a timer for energizing a buzzer 109 for a selected period of time when signals from the latch 112 are all low. When the latch 112 produces an output signal, a control circuit 103 determines and supplies such signal to the motor driver circuit 104.

Operation of the timepiece in accordance with the invention is now described. The counter 111 counts how many times the externally actuated member 110 is operated. The counter 111 is also inputted with a signal from the frequency divider circuit 102 as a clock signal which is assumed here to be indicative of minutes. The clock signals to the counter 111 count down the contents of the counter such that in the example presented the counter 111 is counted down when the number of one-minute clock signals equals the number of actuations of the switch 110.

The counter 111 produces outputs which are stored in the latch 112 which generates an output in sychronization with an input clock signal from the coincidence circuit 115. The output from the latch 112 serves to control the control circuit 103. The coincidence circuit 113 generates an output which enables the motor 105 to move rapidly several times a second. The counter 114 is related by clock signals to the signals for moving the motor 105 rapidly. The coincidence circuit 113 detects coincidence between outputs from the latch 112 and the counter 114 to terminate rapid driving of the motor 105. The second counter 116 serves to control the counter 114 and to count seconds for delivering a clock signal to the latch 112. The second counter 116 also controls coincidence of a rapid movement signal for the counter 114.

For example, when the timer is set for N=4 minutes, the latch 112 produces an output indicative of 4 and the coincidence circuit 115 detects coincidence every four seconds through the second counter 116. Since the output from the coincidence circuit 115 resets both the second counter 116 and the counter 114, the counter 114 produces an output which corresponds to four second intervals and which actuates the control circuit 103 to move the motor 105 at a rapid rate. Likewise, when the latch 112 produces an output of 3 representing three minutes, the counter 114 generates an output which moves the motor rapidly for only three motions in three seconds. Increments by which the motor is driven at a rapid rate are successively reduced so that the number of occurrences at which the timer unit moves the motor rapidly is decreased.

Figure 7:
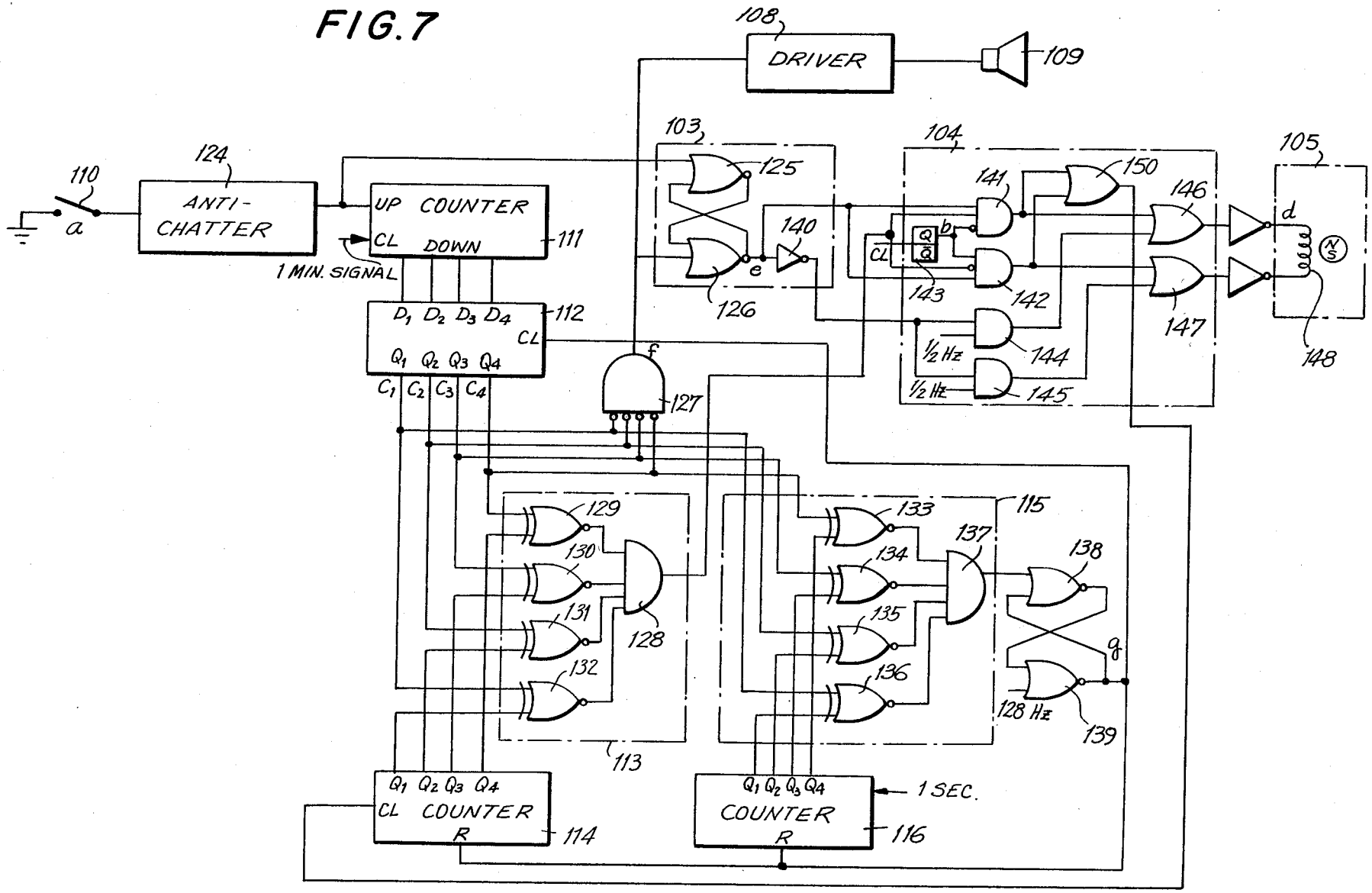
FIG. 7 is a more detailed functional circuit diagram of a portion of FIG. 6.
Figure 8:
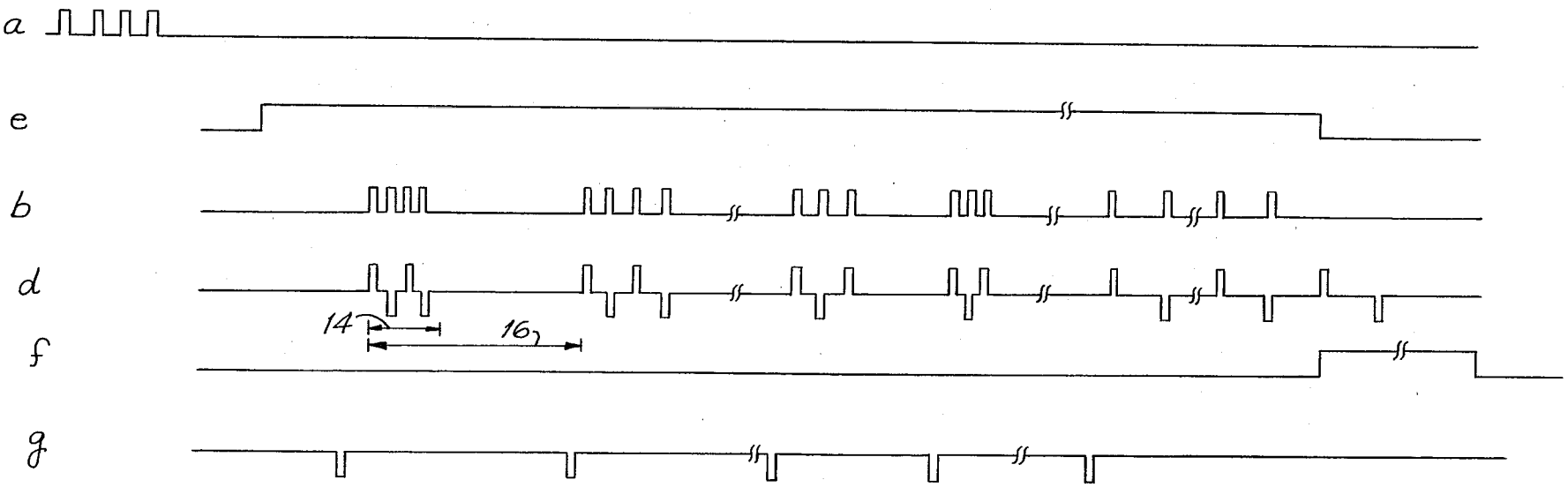
FIG. 8 is timing chart associated with the functional circuit of FIG. 7.

FIGS. 7 and 8 are a circuit diagram and a timing chart for the timing unit shown in FIG. 6. The circuit of FIG. 7 comprises, in addition to the components shown in FIG. 6, exclusive NOR gates 129–136 and AND gates 128,137 for the coincidence circuits 113,115. The circuit also includes an AND gate 127 for energizing the buzzer and supplying a signal to the motor, NOR gates 125,126 and inverter 140 which together constitute the switch control circuit 103, D-type flip-flop 143, AND gates 141,142,144,145 and OR gates 146,147 which jointly constitute a portion of the motor driver circuit 104. Also, included are a coil 148 of the motor 105 and an input anti-chatter circuit 124 operating in conjunction with the externally actuated switch 110.

The circuit of FIG. 7 operates basically in the same manner as that of the circuit shown in the diagram of FIG. 6. When the timepiece is in a normal mode of operation with the switch 110 open, the switch control circuit 103 produces an output e which is at a low logic level. Thereupon, inputs of the AND gates 144, 145 are at a high logic level as a result of the action of the inverter 140. Upon application of ½ Hz signals with a phase difference therebetween to the other inputs of the AND gates 144, 145, the AND gates 144, 145 produce outputs which energize the motor coil 148 through the OR gates 146, 147. Thus, the motor is driven precisely at the rate of one second per second. Such a motor driver circuit is of known construction and no further detailed description thereof is presented herein.

When the switch 110 is actuated N times, that is, the timepiece starts acting as a timer, a signal is delivered through the anti-chatter circuit 124 to enable the timer setting counter 111 to count up. Then the counter 111 is driven for counting down by the clock input for minutes. The clock input occurring at intervals of one minute are from the timekeeping divider circuit 102. The up/down counter 111 is of known construction and further detail thereof is omitted. The counter 111 now operates as an N-minute counter, that is, it is counted down to zero in N minutes. A signal corresponding to N is supplied from the counter 111 to the latch 112.

To produce output signals C1,C2,C3,C4 corresponding to output Q1,Q2,Q3,Q4 of the latch 112, and to produce an output for driving the motor at a rapid rate, outputs from the counter 114 and the latch 112 are compared by the coincidence circuit 113 in FIG. 7. Upon coincidence with the signal N from the latch 112, the AND gate 128 outputs a signal which is applied to the D-type flip-flop 143 to terminate rapid motor dividing as described hereinafter. The flip-flop 143 is clocked with a quick-feed signal from the divider circuit 102, for example, 3,16, or 32 Hz, and produces a signal b which is applied to the gates 141,142 having output signals which are fed through the OR gates 146,147 to the motor coil 148. The switch control circuit 103 is set by the input switch 110 which causes the signal e of the NOR gate 126 to be high, with the outputs of the AND gates 141,142 being high. Thus, the output signal from the coincidence circuit 113 can be accepted by the gates 141,142 and the motor 105 is now driven rapidly N times by a signal indicative of rapid movements.

The OR gate 150 senses the signals outputted from the gates 141,142, and for each motion of the motor provides a clock signal input to the counter 114. Accordingly, the counter 114 receives only N clock pulses, corresponding to only N motor motions, to produce an equality in the comparison circuit 113 with the signal N from the latch 112. The driving pulses b to the motor 105 commence after the signal g resets the counters 114,116.

The second counter 116 is supplied with a second signal as a clock input. Coincidence between the output C1,C2,C3,C4 of the latch 112, which are a signal indicative of N (minutes) and outputs of the second counter 116 is detected by the coincidence circuit 115. Thereupon, the AND gate 137 and coincidence detector 115 produce an output that causes the NOR gates 138,139 to produce an output g which simultaneously resets the second counter 116 and the counter 114. With the clock signal for driving the motor rapidly N times being supplied to the flip-flop 143, the counter 114 generates a signal allowing for driving the motor N times each time it is reset. Thus, the signal pulses for driving the motor N times are repeatedly reduced. The clock signals into the counter 114 are at a frequency with a period substantially less than the period for resetting the counter 114.

The output g of the NOR gate 139 is applied as a clock to the latch 112, so that outputs from the counter 111 are temporarily stored in the latch 112, and the latch 112 delivers synchronized latch output signals at start-up, the initial reset of motor driving signals b occurs after the first output g resets the counter 114.

A signal for moving the motor rapidly N times is repeatedly generated for one minute. For example, when N=4, the motor is driven rapidly four times, four seconds later the motor is again driven rapidly four times, and so on repetitively. After one minute has elapsed, a clock signal counting down the counter 111, causes the counter 111 to produce an output signal representative of N−1. Therefore, the outputs Q1,Q2,Q3,Q4 of the latch 112 produce an output signal representative of N−1. In the same process as described above, the counter 114 in the coincidence circuit 113 receives rapid drive-clock signals corresponding the rapid drive of N−1 pulses representing three minutes, and the counter 116 in the coincidence circuit 115 repeatedly generates a reset signal g to initiate the rapid at N−1 second intervals. Similarly, the flip-flop 143 supplies a rapid drive signal N−2 for the next one minute, and hence, its output b becomes successively decreased at increments of one minute. In summary, the motor and second hand are driven first for N pulses at a rapid rate in increments of N seconds for one minute when the switch 110 is depressed N times, then the motor and second hand are driven in bursts of N−1 pulses for one minute in increments of N−1 seconds, N−2 seconds . . . one second. Thereupon, the second hand moves intermittently in increments of one second per second for the final one minute.

When the timer operation is over, that is, all of the outputs C1 through C4 of the latch 112, which serves as a memory of the counter 111 become low, the output f of the AND gate 127 goes high, energizing the buzzer driver circuit 108 including a timer to cause a buzzer 109 to give off a sound for a preselected time period. At the same time, the output f of the AND gate 127 is supplied to the NOR gate 126 in the switch control circuit 103 to indicate that timer operation is completed by reversing the condition of the output signal e. The motor driver circuit now returns to a normal mode of operation in which the second hand is driven every second through the AND gates 144,145 and the OR gates 146,147 as described above.

Although in the illustrated embodiment, the second hand is driven at variable rates as the remaining interval for which the timer is set is reduced, or as the remaining time in the timer varies, in an alternative embodiment in accordance with the invention, the hand may be moved at the same rapid rate determined at the initial timer setting until the timer operation is complete. Such an arrangement may be achieved by omitting portions of the structure described above. In FIG. 7, the timer unit may comprise the setting counter 111 and the counter 114 for providing a signal driving the motor rapidly. The second counter 116 in the coincidence circuit 115 may be omitted. This modified construction is basically the same as that already described and its detailed description is omitted here. However, the number N at which the timer is originally set is N constant as an input N to the gate 128 of the coincidence circuit 113 shown in FIG. 7. Therefore, the second hand will move rapidly in increments of N steps for one stroke until the timer operation is over.

In the illustrated embodiment, the number of operations of the externally actuated member is used to set minutes, and the hand is moved in increments of seconds. However, the timer may be set for hours and the hand may be driven rapidly in increments representing N hours. It is thus freely possible to adapt the time indicator to desired timer functions. In practice users generally set the timer for minutes and the foregoing embodiment in which the externally actuated member and the second hand are set for minutes and driven in seconds respectively, finds a highly practical usage as a mechanism which is quite easy to operate.

As described above, when an electronic timepiece with an analog quartz crystal timer is provided with an electronic circuit for rendering movements of a second hand responsive to intervals for which the timer is set, thereby, the intervals of timer setting are visually confirmed. Thus, a simple timer is constructed without requiring a special digital display. This ability to visually confirm the timer setting allows users to rely on the timepiece in practice. The construction of the invention makes it possible to provide multiple functions in an analog timepiece.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic timepiece including a high frequency signal generator, frequency divider network dividing down said high frequency signal to lower frequency signals, a driver circuit receiving a divided frequency signal from said divider network, and an indicator of time operated by the output of said driver circuit, the improvement therein comprising a countdown timer, comprising:

input switch means;

audible output means;

driving circuit means for driving said audible output means, said audible output means being driven to an audible output in response to each actuation of said input switch means, said audible output means indicating the desired setting time of said timer function;

first counter means for counting and memorizing the number of actuations of said input switch means, said number of actuations defining a selected timed period, said first counter means being coupled to said input switch means;

second counter means coupled to said frequency divider network, said second counter means counting elapsed time after actuation of said input switch means;

coincidence detection means for detecting when the number of counts in said first counter means and the number of counts in said second counter means are coincident, said coincident detection means transmitting a signal to said audible output means upon said detection.

2. An electronic timepiece as claimed in claim 1, wherein said input switch means is externally mounted on said timepiece and operated by pushing.

3. An electronic timepiece as claimed in claim 1, wherein each input switch means actuation represents an additional increment of elapsed time for timing, each said increment of elapsing time being measured within said second counter means by accummulation of frequency signals from said divider network.

4. An electronic timepiece as claimed in claim 4 which further includes detection means for determining whether or not the number of actuations of said input switch means is greater than a predetermined value, said detection means outputting distinctive signals indicating said detection, said driving circuit means and audible output means being adapted to output one or another audible signal respectively in response to said distinctive signals from said detection means.

5. An electronic timepiece as claimed in claim 4, wherein the number of switch actuations is not greater than said selected value, and the audible output response is a series of periodic timer sounds during the entire selected timed period.

6. An electronic timepiece as claimed in claim 4, wherein the number of switch actuations is greater than said selected value and the response of said audible output means is a time signal at the end of the selected timed period.

7. An electronic timepiece as claimed in claim 1, wherein said timepiece is an analog timepiece with mechanical hands.

8. An electronic timepiece as claimed in claim 4, wherein said timepiece is an analog timepiece with mechanical hands.

9. An electronic analog timepiece as claimed in claim 1 and further including a motor operated by the output of said driver circuit, and said indicator of time having a plurality of hands operated by the output of said motor, and wherein said supplemental function is a timer including an input switch, a counter for counting the number of actuations of said input switch, and means for moving one of said hands, said hand movement being indicative of the number of counts in said counter.

10. An electronic analog timepiece with a timer function as claimed in claim 9, wherein said counter is an up-down counter, and each input switch actuation represents an additional increment of elapsed time for timing, each said increment of elapsed time being counted down within said counter by selected frequency signals from said divider network, said selected frequency signal having a period equalling said increment of time.

11. An electronic analog timepiece with a timer function as claimed in claim 9 or 10, wherein said timer function further includes a latch, said latch storing and outputting data corresponding to the instantaneous count in said counter, and a second counter, said second counter counting second signals from said divider network, a first comparison circuit, said first comparison circuit comparing the output of said latch with the output of said second counter, coincidence between said latch and said second counter output data causing said first comparison circuit to output a signal resetting said second counter and clocking said latch, said latch being clocked and said second counter being reset every N seconds, N being the number of counts indicated at the output of said latch, said means for moving said at least one hand being operated to move said at least one hand after each resetting of said second counter.

12. An electronic analog timepiece with a timer function as claimed in claim 9 or 10, wherein said hand operates to move one increment for each count of said counter, the number of said movements decreasing as said counter is counted down, the diminishing number of said movements indicating the time remaining of the selected timed interval.

13. An electronic analog timepiece with a timer function as claimed in claim 12, wherein said hand moves by an increment representing one second on the face of said timepiece for each minute of time remaining as indicated by the count N of said counter.

14. An electronic analog timepiece with a timer function as claimed in claim 11, wherein said hand operates to move one increment for each count of said counter, the number of said movements decreasing as said counter is counted down, the diminishing number of said movements indicating the time remaining of the selected timed interval.

15. An electronic analog timepiece with a timer function as claimed in claim 14, wherein said means for moving said at least one hand is adapted to provide N movements in a time period substantially less than said N second period for resetting said latch and said second timer.

16. An electronic analog timepiece with a timer function as claimed in claim 15, wherein said means for moving includes a third counter being clocked with a signal having said time period substantially less than N seconds, and a second comparison circuit comparing the output of said latch and said third counter, coincidence of said signals in said second comparison circuit causing an output for controlling the driving of said at least one hand with said clock signal.

17. An electronic analog timepiece with a timer function as claimed in claim 16, wherein said second and third counters are simultaneously reset by said first comparison circuit.

18. In an electronic timepiece including a high frequency signal generator, a frequency divider network dividing down said high frequency signal to at least one lower frequency signal, a driver circuit receiving a divided frequency signal from said divider network, and an indicator of time operated by the output of said driver circuit, the improvement therein comprising:

count down means for performing the function of a chronograph, the count down means having the divided frequency signal from the divider network as an input;

switch means providing a first control signal for initiating counting of the divided frequency signal by the count down means and a second control signal for stopping the count down means to provide a data signal representing the time interval counted thereby;

audible output means; and drive means responsive to the first control signal to cause the audible output means to emit a sound indicating the start of a measurement and to the second control signal and the data signal to emit a different sound representative of the measured elapsed time.

19. An electronic timepiece as claimed in claim 18, wherein said switch means comprises first and second switches respectively providing said first and second control signals and said audible output means comprises a speaker, and further comprising:

first voice signal generating means responding to said first control signal to provide an audible output indicating the start of measurement; and second voice generating means activated by the second control signal to provide an audible output of the elapsed time.

20. An electronic timepiece as claimed in claim 19 wherein said count down means further comprises:

memory means for storing the data signal representing the time interval, the second voice generator means having the stored data as one input.

21. An electronic timepiece as claimed in claim 18 wherein the drive means transmits voice signals to the audible output means to cause it to emit sounds representative of the measured elapsed time.

22. An electronic timepiece as claimed in claim 18, wherein the sound which indicates the start of a measurement comprises a voice signal.

* * * * *